US006675711B2

(12) United States Patent
Kawamura et al.

(10) Patent No.: US 6,675,711 B2
(45) Date of Patent: Jan. 13, 2004

(54) APPARATUS FOR FEEDING AND EJECTING A PRINTING PLATE ONTO A SURFACE PLATE

(75) Inventors: Yoshinori Kawamura, Kanagawa (JP); Mamoru Murata, Saitama (JP)

(73) Assignees: Fuji Photo Film Co., Ltd., Kanagawa (JP); Fuji Photo Optical Co., Ltd., Saitama (JP)

( * ) Notice: Subject to any disclaimer, the term of this patent is extended or adjusted under 35 U.S.C. 154(b) by 110 days.

(21) Appl. No.: 09/983,606

(22) Filed: Oct. 25, 2001

(65) Prior Publication Data

US 2002/0046671 A1 Apr. 25, 2002

(30) Foreign Application Priority Data

Oct. 25, 2000 (JP) ..... 2000-325729

(51) Int. Cl.[7] ..... B65H 5/04; B41L 47/14

(52) U.S. Cl. ..... 101/477; 271/306; 271/188; 355/407

(58) Field of Search ..... 101/477, 463.1, 101/467, 494; 414/793.4; 271/264, 306, 188; 355/407, 27, 40

(56) References Cited

U.S. PATENT DOCUMENTS

| | | | | |
|---|---|---|---|---|
| 4,389,156 A | * | 6/1983 | Dennhardt et al. | 414/20 |
| 4,411,356 A | | 10/1983 | Radas | |
| 4,462,678 A | | 7/1984 | Back | |
| 4,995,859 A | * | 2/1991 | Totani | 493/204 |
| 6,457,414 B1 | * | 10/2002 | Kato et al. | 101/477 |

* cited by examiner

*Primary Examiner*—Leslie J. Evanisko
(74) *Attorney, Agent, or Firm*—Sughrue Mion, PLLC

(57) ABSTRACT

A receiving guide is attached to an upper portion of a discharge mechanism section via a bracket. When a photopolymer plate is discharged from a photopolymer plate conveying section, a leading end portion of the photopolymer plate, which is in a state of hanging down slightly, abuts a flat plate portion of the receiving guide. Thereafter, the receiving guide moves in accordance with movement of the leading end portion of the photopolymer plate. Further, the receiving guide moves forward in a conveying direction of the photopolymer plate immediately before conveying of the photopolymer plate is completed, and the photopolymer plate lands on the surface plate.

12 Claims, 11 Drawing Sheets

Prior Art FIG. 11A
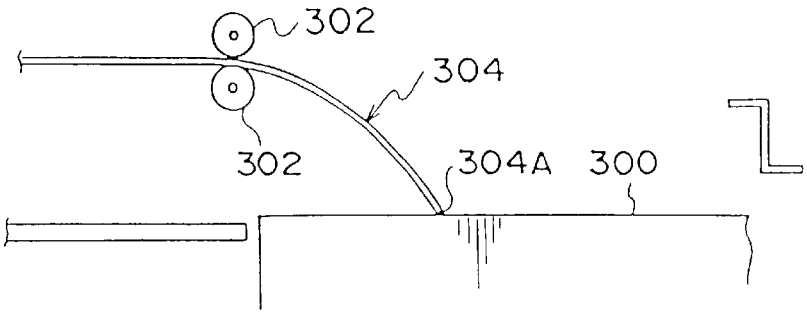
Prior Art FIG. 11B
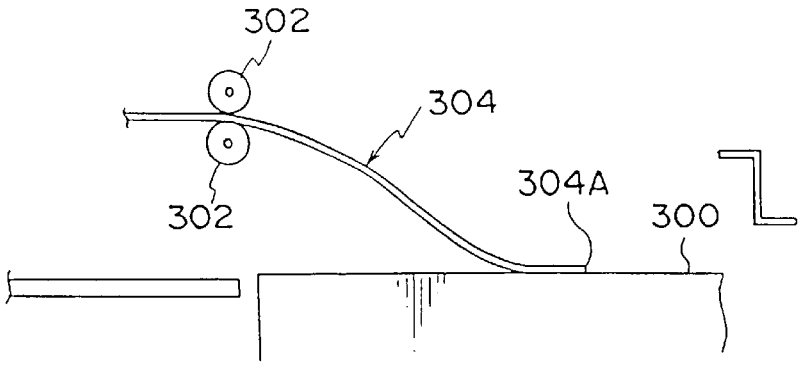
Prior Art FIG. 11C
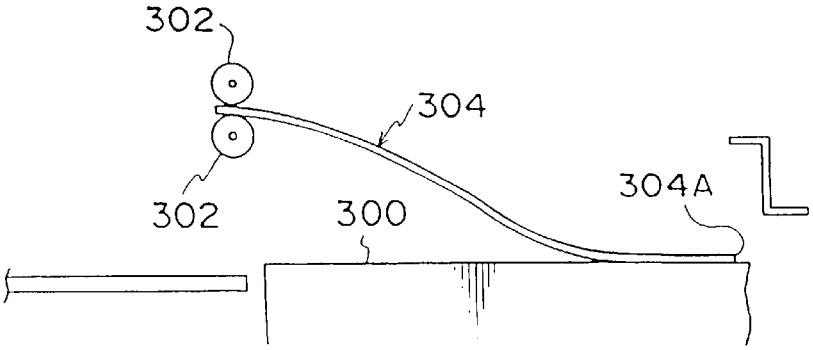

APPARATUS FOR FEEDING AND EJECTING A PRINTING PLATE ONTO A SURFACE PLATE

BACKGROUND OF THE INVENTION

1. Field of the Invention

The present invention relates to a printing plate receiving guide mechanism and a method of receiving and guiding for receiving a leading end portion of a printing plate which is fed onto a surface plate of an exposure stage or the like.

2. Description of the Related Art

A technique (printing plate automatic exposing device) has been developed in which, by using a printing plate (for example, a PS plate, a thermal plate, a photopolymer plate, or the like) in which a recording layer is provided on a support, an image is recorded directly by a laser beam onto the photopolymerizable layer of the printing plate.

In this technique, in order to rapidly carry out image recording onto printing plates, the printing plates must be fed one after the other. A plurality of printing plates are made to wait in a stacked state at a predetermined position, and are automatically removed one at a time, positioned on a surface plate, and fed into an exposure section.

Here, in a case in which the printing plate is set on the surface plate, conventionally, a printing plate 304 is nipped by rollers 302 disposed in the vicinity of a surface plate 300, and is conveyed to the predetermined position on the surface plate 300 (FIGS. 11A through 11C).

However, with the aforementioned conventional positioning method, a leading end 304A of the printing plate 304 falls directly onto the surface plate 300 (FIG. 11A). Thereafter, the leading end 304A of the printing plate 304 slides on the surface plate 300 (FIG. 11B), and reaches a predetermined position on the surface plate 300 (FIG. 11C). As a result, there is the concern that the upper surface of the surface plate 300 may be abraded or scratches may be formed on the upper surface of the surface plate 300, and there is the concern that the reverse surface of the printing plate 304 may be scratched due to these scratches and the like.

SUMMARY OF THE INVENTION

In view of the aforementioned, an object of the present invention is to provide a receiving guide mechanism for use in printing plate feeding which can prevent abrasion and scratching of a surface plate, and can prevent scratching of a reverse surface of a printing plate.

A receiving guide mechanism used in printing plate feeding of a first aspect of the present invention comprises: a receiving guide which receives, above a surface plate, a leading end portion of a printing plate which is to be set on the surface plate; and a guide driving device which moves the receiving guide in accordance with movement of the leading end portion of the printing plate, and due to the receiving guide being made to escape forward in a conveying direction of the printing plate immediately before conveying of the printing plate is completed, the printing plate is set on the surface plate.

In accordance with the receiving guide mechanism of the first aspect of the present invention, when the printing plate is conveyed onto the surface plate, the receiving guide receives the leading end portion of the printing plate above the surface plate. Further, due to the guide driving device, the receiving guide moves in accordance with the movement of the leading end portion of the printing plate, and escapes forward in the conveying direction of the printing plate immediately before conveying of the printing plate is finished. As a result, because the leading end of the printing plate does not fall directly on the surface plate and thereafter slide on the surface plate as in conventional structures, there is no abrasion and scratching of the top surface of the surface plate. Thus, abrasion and scratching of the surface plate can be prevented, and scratching of the reverse surface of the printing plate can be prevented.

In the receiving guide mechanism used in printing plate feeding of the first aspect of the present invention, preferably, the moving speed of the receiving guide is faster than the conveying speed of the printing plate immediately before conveying of the printing plate is finished.

In the receiving guide mechanism, preferably, the moving speed of the receiving guide is made to be faster than the conveying speed of the printing plate immediately before conveying of the printing plate is finished. Thus, immediately before conveying of the printing plate is completed, the receiving guide can reliably escape forward in the conveying direction of the printing plate due to the relative movement between the receiving guide and the printing plate. Therefore, the printing plate can be made to reliably land on the surface plate.

In the receiving guide mechanism used in printing plate feeding of the first aspect of the present invention, preferably, the receiving guide is provided at a discharge device for discharging the printing plate from above the surface plate.

In the receiving guide mechanism, preferably, due to the receiving guide being provided at the discharge device for discharging the printing plate from above the surface plate, supporting members and a guide driving device of the receiving guide can be commonly used as supporting members and a driving device of the discharge device. Thus, the number of parts can be decreased.

As described above, the receiving guide mechanism used in printing plate feeding relating to the present invention has excellent effects in that abrasion and scratching of the surface plate can be prevented, and in that scratching of the reverse surface of the printing plate can be prevented. Further, the receiving guide can reliably escape forward in the conveying direction of the printing plate immediately before the conveying of the printing plate is finished. The printing plate can be reliably conveyed and set on the surface plate without the conveying of the printing plate being impossible due to the printing plate sliding on the surface plate and static electricity being generated due to friction and the printing plate clinging due to the electrification. Moreover, the receiving guide mechanism of the present invention has another excellent effect in that the number of parts can be reduced.

BRIEF DESCRIPTION OF THE DRAWINGS

FIG. 11A is a side view illustrating an operation of conveying a printing plate onto a surface plate immediately after the start of conveying in a conventional structure.

FIG. 11B is a side view illustrating an operation of conveying the printing plate onto the surface plate at an intermediate stage of conveying in the conventional structure.

FIG. 11C is a side view illustrating an operation of conveying the printing plate onto the surface plate immediately before completion of conveying in the conventional structure.

DESCRIPTION OF THE PREFERRED EMBODIMENTS (Overall Structure)

Figure 1:
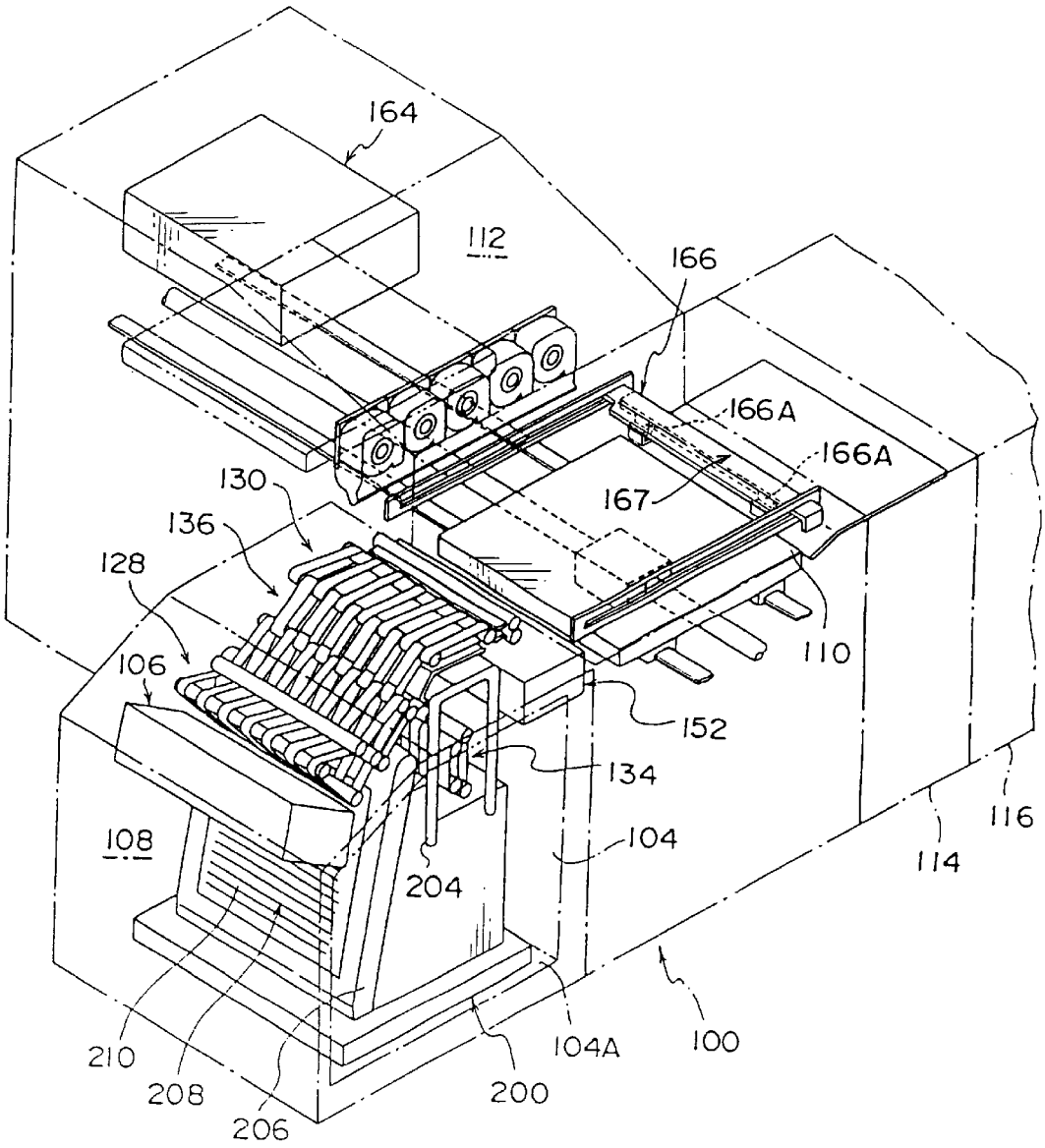
FIG. 1 is a perspective view illustrating the overall structure of an automatic exposing device having a receiving guide mechanism used in printing plate feeding, relating to an embodiment of the present invention.

FIG. 1 illustrates an automatic exposing device 100 for photopolymer plates which is equipped with a receiving guide mechanism used in printing plate feeding relating to an embodiment of the present invention.

The automatic exposing device 100 is formed by a plate supplying section 108, a surface plate 110, and an exposing section 112. The plate supplying section 108 includes a plate accommodating section 104 which accommodates photopolymer plates 102 (see FIG. 2) loaded at a carriage 200, and a sheet section 106 which takes out the photopolymer plate 102 accommodated in the plate accommodating section 104. The photopolymer plate 102 is positioned and held at the surface plate 110. The exposing section 112 records an image onto the photopolymer plate 102 positioned on the surface plate 110. An automatic developing device 116 can be set, via a buffer section 114, at the downstream side of the automatic exposing device 100. In this way, all of the processes of plate supplying, exposure, and developing can be carried out automatically.

Figure 2:
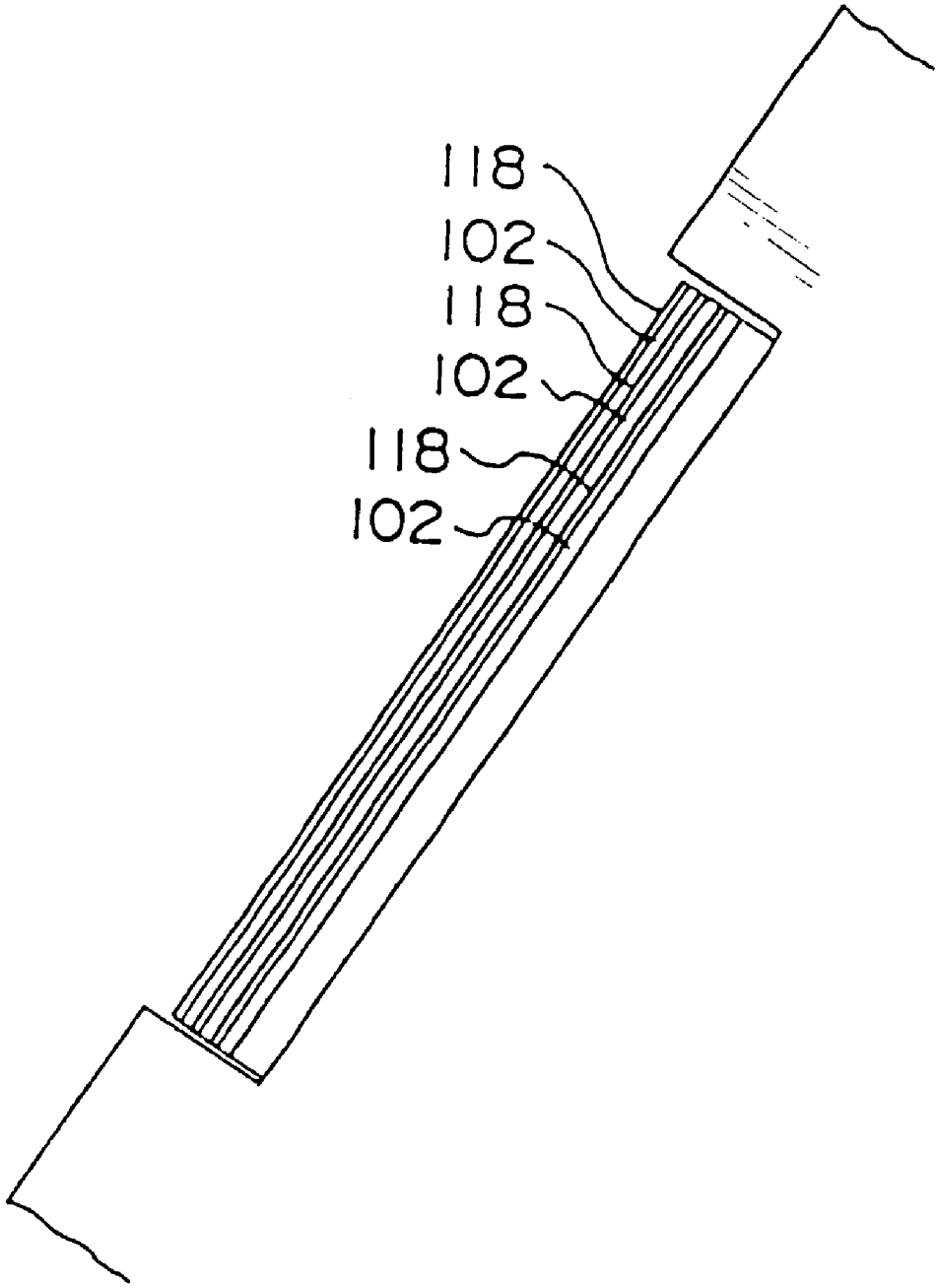
FIG. 2 is a side view illustrating a state of interleaf sheets and photopolymer plates stacked in a magazine.
Figure 3:
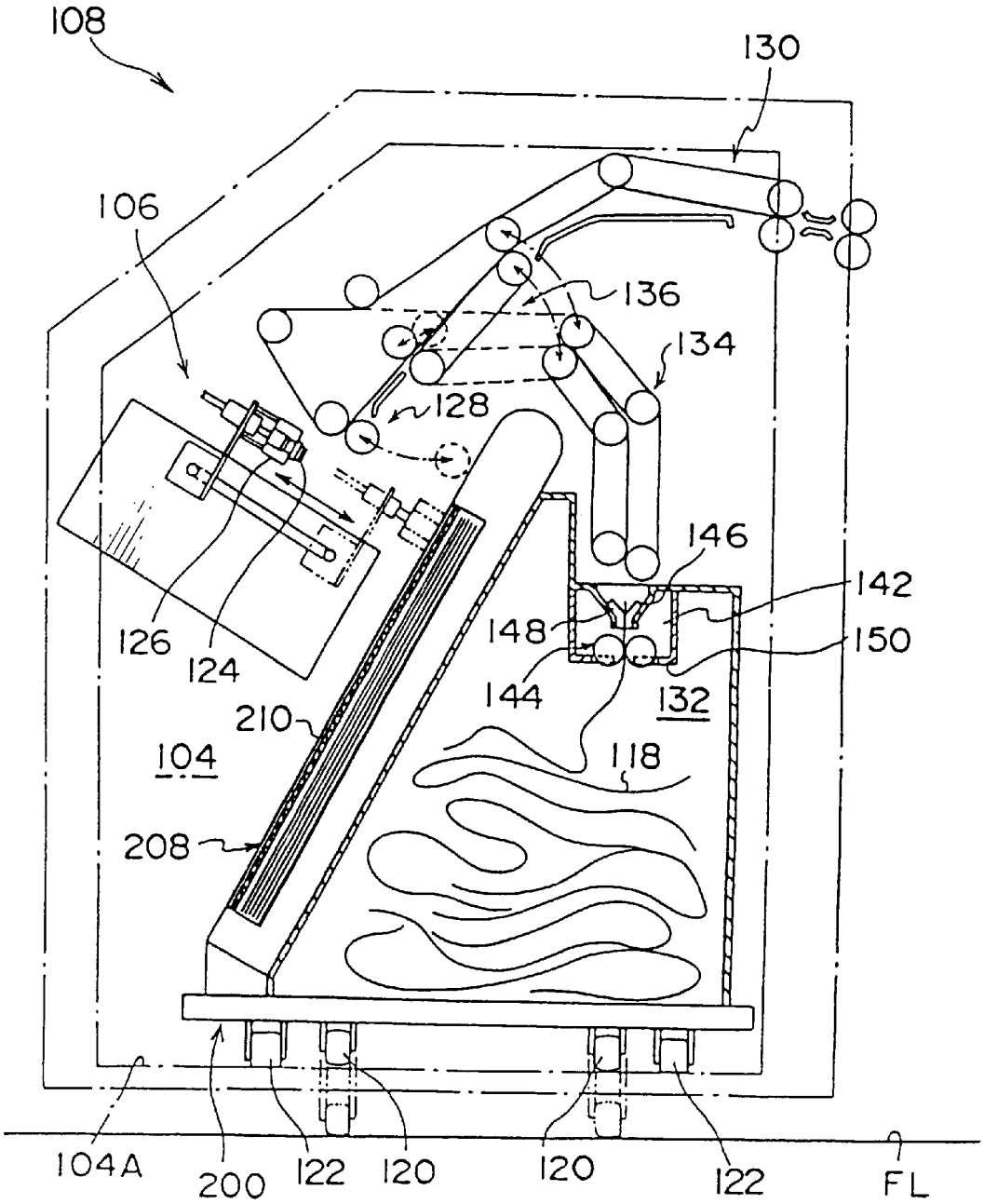
FIG. 3 is a side view of a plate supplying section.

A carriage 200, in which a plurality of the photopolymer plates 102 can be set, can be accommodated in the plate accommodating section 104 (FIG. 3). Further, a single interleaf sheet 118 for protection is provided at the surface of each of the photopolymer plates 102. As a result, the photopolymer plates 102 and the interleaf sheets 118 are stacked alternately (FIG. 2).

A floor portion 104A is formed at the plate accommodating section 104 at a position which is higher than the floor surface, so that the carriage 200 can be lifted up onto the floor portion 104A from the floor surface. Namely, the carriage 200 is supported at the floor surface via casters 120, and the casters 120 are movable, with respect to the carriage 200, between a projecting position (shown by the imaginary lines in FIG. 3) and an accommodated position (shown by the solid lines in FIG. 3).

In accordance with the operation of accommodating the carriage 200 into the plate accommodating section 104, the casters 120 are moved to their accommodated positions so as to be folded-up upwardly. Simultaneously, auxiliary rollers 122 correspond to the floor portion 104A. Thereafter, the carriage 200 is supported via the auxiliary rollers 122 with respect to the floor portion 104A.

The sheet section 106 is provided above the plate accommodating section 104. The sheet section 106 takes out the alternately stacked photopolymer plates 102 and interleaf sheets 118, and feeds the photopolymer plate 102 or the interleaf sheet 118 to the plate feeding section 108. Thus, the sheet section 106 is provided with a suction cup 124 which sucks the photopolymer plate 102 or the interleaf sheet 118. Further, a suction fan 126 is provided, in a vicinity of the suction cup 124 and separately from the suction cup 124, as an assisting device at the time the interleaf sheet 118 is sucked. The suction cup 124 and the suction fan 126 can be made to approach or made to move away from the topmost layer of the interleaf sheets 118 and the photopolymer plates 102 which are integrally stacked together.

Here, when the photopolymer plate 102 is to be suction adhered, the suction cup 124 is made to contact the photopolymer plate 102 such that the photopolymer plate 102 is suction adhered. When the interleaf sheet 118 is to be sucked, the suction fan 126 is disposed at a position which is slightly apart from the interleaf sheet 118 (or may contact the interleaf sheet 118). By operating only the suction fan 126, only the interleaf sheet 118, which is lightweight and thin, is sucked up, and thereafter, the interleaf sheet 118 is suction adhered by the suction cup 124. In this way, the photopolymer plate 102 positioned beneath the interleaf sheet 118 can be prevented from being sucked up together with the interleaf sheet 118.

The plate supplying section 108 is basically structured by a common conveying section 128, a photopolymer plate conveying section 130, an interleaf sheet conveying section 134, and a switching conveying section 136. The common conveying section 128 receives and conveys the photopolymer plate 102 or the interleaf sheet 118 from the sheet section 106. The photopolymer plate conveying section 130 receives the photopolymer plate 102 and sends the photopolymer plate 102 out to the surface plate 110. The interleaf sheet conveying section 134 receives the interleaf sheet 118 and feeds the interleaf sheet 118 out to an interleaf sheet accommodating box 132 (which is loaded at the carriage 200). The switching conveying section 136 carries out guiding by switching from the common conveying section 128 to either of the photopolymer plate conveying section 130 or the interleaf sheet conveying section 134.

Namely, because the photopolymer plates 102 and the interleaf sheets 118 are alternately stacked, each time sucking is carried out at the plate section 106, the switching conveying section 136 carries out switching, such that the photopolymer plates 102 and the interleaf sheets 118 are conveyed in respectively different predetermined directions.

Figure 4A:
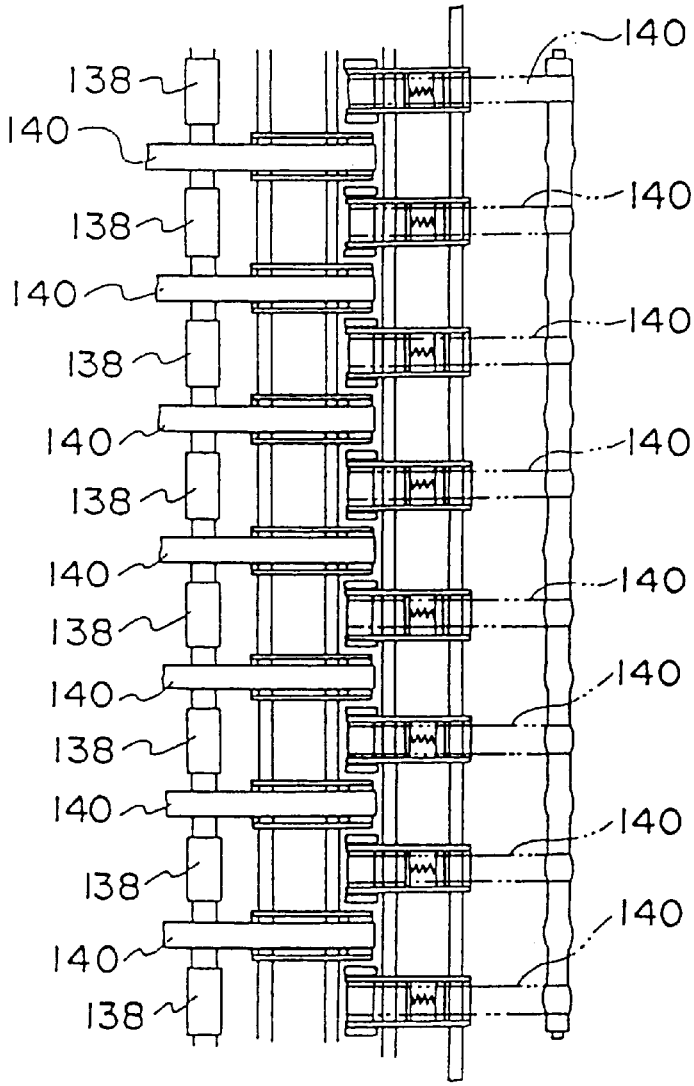
FIG. 4A is a plan view illustrating a portion of a conveying system of the plate supplying section.
Figure 4B:
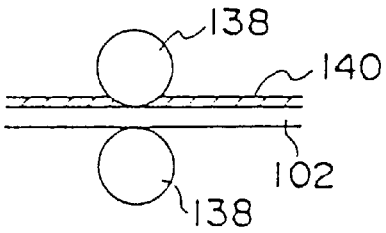
FIG. 4B is a sectional view illustrating a portion of the conveying system of the plate supplying section.
Figure 4C:
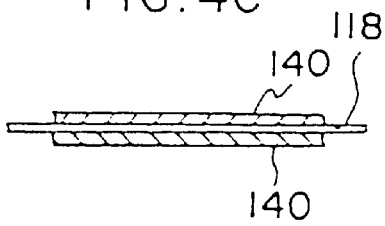
FIG. 4C is a sectional view illustrating a portion of the conveying system of the plate supplying section.

Here, the common conveying section 128, the photopolymer conveying section 130, and the switching conveying section 136 are a conveying system in which skewer rollers 138 and narrow belts 140 are combined (FIG. 4A). The main function is the conveying of the photopolymer plates 102 (see FIG. 4B). Namely, the photopolymer plate 102 is conveyed by the strong nipping force of the skewer rollers 138, and the narrow belts 140 function as guide plates which move synchronously with the conveying. In contrast, the interleaf sheet conveying section 134 is a conveying system formed only by narrow belts 140 (FIG. 4C), and conveys the interleaf sheet 118 by weak nipping force of the narrow belts 140.

Figure 5:
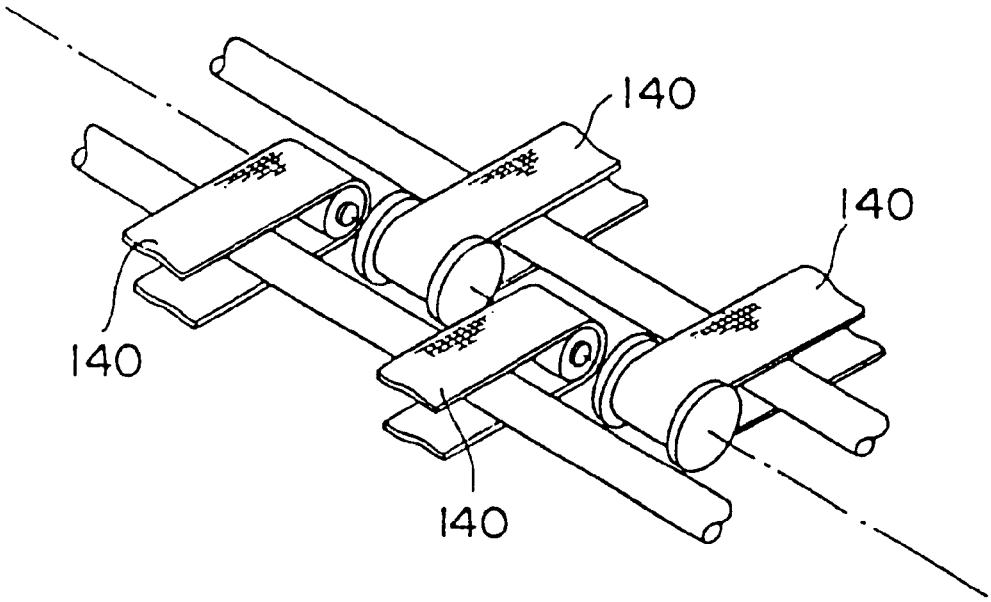
FIG. 5 is a perspective view illustrating a transfer section of a different conveying system of the plate supplying section.

Here, the leading end portions of the transfer sections at each conveying section project out in skewer forms alternately (FIG. 5), and overlap such that the concave or convex distal end of one conveying section opposes the convex or concave distal end of the other conveying section (so as to form a coaxial, common conveying path). In this way, at the time the photopolymer plate 102 and the Interleaf sheet 118 are transferred, they can be prevented from getting wound up on the skewer rollers 138 and the narrow belts 140.

The interleaf sheet 118 conveyed by the interleaf sheet conveying section 134 is guided into the interleaf sheet accommodating box 132 provided at the carriage 200 (FIG. 3). A pair of rollers 144 are provided at an insertion opening 142 for the interleaf sheet 118, which is provided at the upper portion of the interleaf sheet accommodating box 132. The rollers 144 rotate at a linear speed which is slightly faster (about 1.1 times faster) than the conveying speed of the interleaf sheet conveying section 134. In this way, when the interleaf sheet 118 is transferred over between the interleaf sheet conveying section 134 and the rollers 144, the interleaf sheet 118 is conveyed while being maintained in a state of predetermined tension, such that jamming caused by the interleaf sheet 118 going slack or the like can be prevented.

Taper shaped guide plates 146, whose widths (in the direction of thickness of the interleaf sheet 118) become gradually thinner, are provided in a vicinity of the insertion opening 142. A charge-removing brush 148 is mounted to each of the guide plates 146 which are formed in taper shapes and which oppose one another. The charge-removing brushes 148 remove charges from the interleaf sheet 118 inserted into the insertion opening 142.

The pair of rollers 144 are skewer rollers, and a partitioning plate 150 is provided so as to follow along the convexities and concavities formed by the skewer shapes of the rollers 144. In this way, even if the rollers 144 contact a portion of the interleaf sheet 118 which has been accommodated in the interleaf sheet accommodating section 134, the interleaf sheet 118 is prevented, by the partitioning plate 150, from being wound up.

Figure 6A:
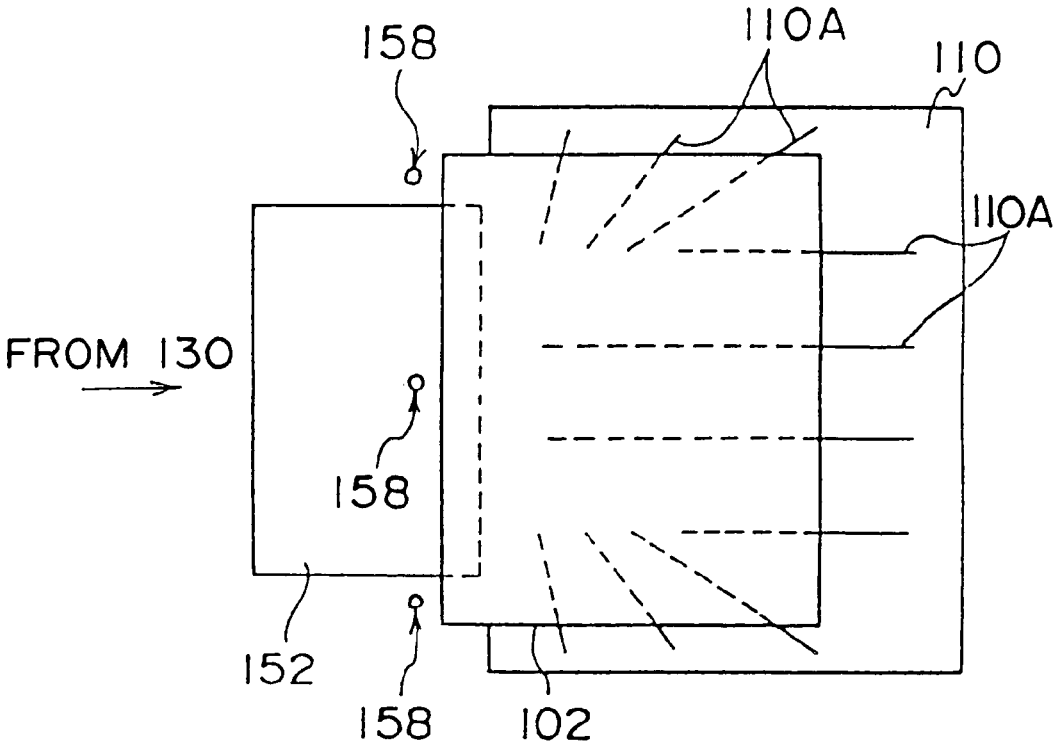
FIG. 6A is a plan view of a surface plate.
Figure 6B:
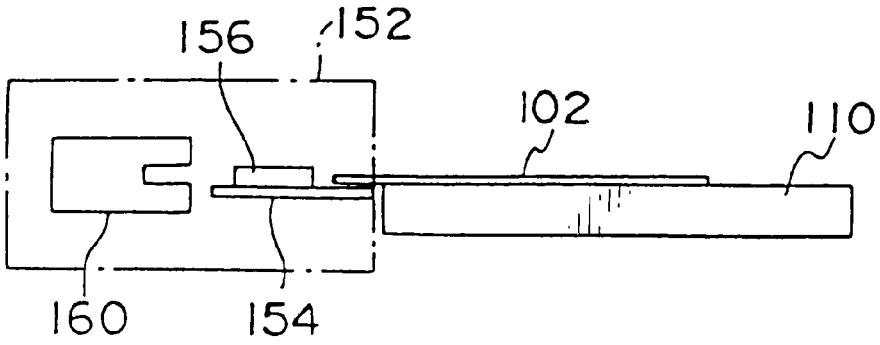
FIG. 6B is a side view of the surface plate.

The photopolymer plate 102 conveyed by the photopolymer plate conveying section 130 moves away from the photopolymer plate conveying section 130 while being conveyed horizontally, and is transferred onto the surface plate 110 (FIG. 6).

Here, the height of the upper surface of the surface plate 110 is at a position which is lower than the horizontal conveying height of the photopolymer plate conveying section 130, and a slight gap is formed between the photopolymer plate conveying section 130 and the surface plate 110 in the conveying direction.

A discharge mechanism section 166 serving as a discharge device stands by in a vicinity of an end portion of the surface plate 110 at the side which is the farthest from the photopolymer plate conveying section 130 (FIG. 1). Due to a driving device such as a motor or the like (not shown), the discharge mechanism section 166 can be made to pass above the surface plate 110 and move to a vicinity of the end portion of the surface plate 110 at the side near to the photopolymer plate conveying section 130.

Figure 7A:
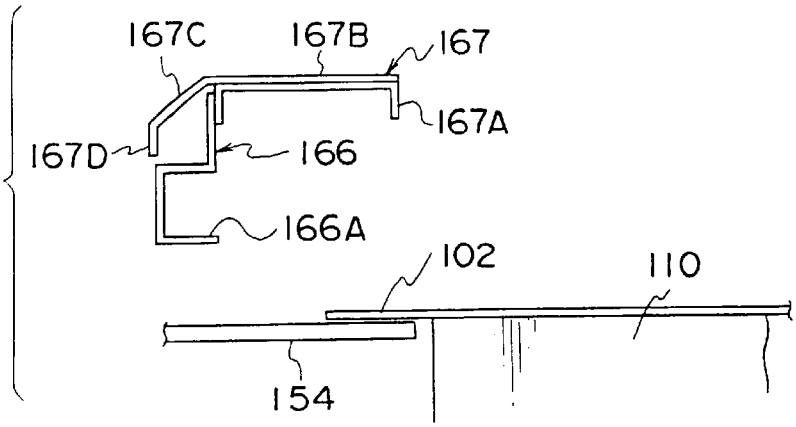
FIG. 7A is a side view illustrating operation of a discharge mechanism section in a state in which operation initially starts.

A receiving guide 167 serving as a portion of the receiving guide mechanism is attached via a bracket 167A to the upper portion of the discharge mechanism section 166 (FIG. 7A). Further, an incline portion 167C is formed at a downward angle at the photopolymer plate conveying section 130 side end portion of a flat plate portion 167B of the receiving guide 167. A flange 167D is formed so as to be directed downward at the lower end portion of the incline portion 167C.

Figure 10A:
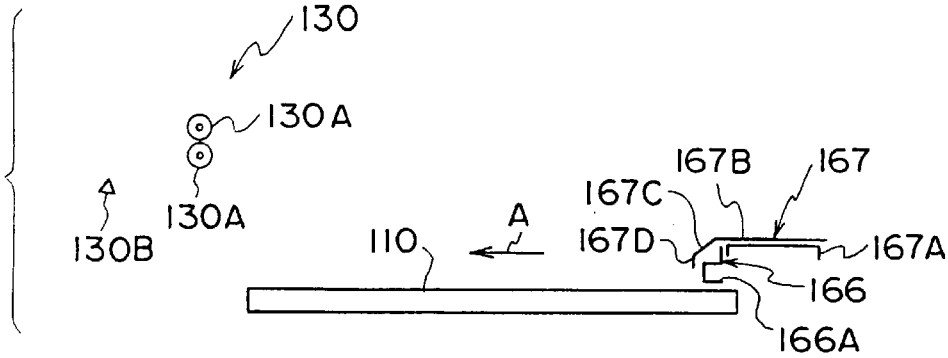
FIG. 10A is a side view illustrating operation of a receiving guide mechanism, and shows a standby position.
Figure 10B:
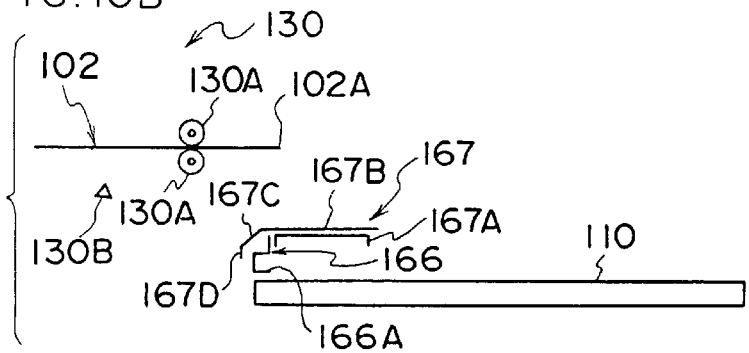
FIG. 10B is a side view illustrating operation of the receiving guide mechanism, and shows a starting position.
Figure 10C:
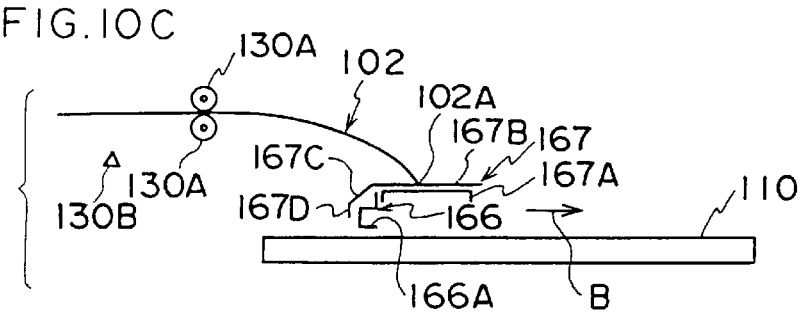
FIG. 10C is a side view illustrating operation of the receiving guide mechanism, and shows a receiving position.

Thus, when the photopolymer plate 102 is discharged from the photopolymer plate conveying section 130, a leading end portion 102A thereof abuts the flat plate portion 167B of the receiving guide 167 in a state in which the photopolymer plate 102 hangs down slightly (FIG. 10C).

Thereafter, the receiving guide 167 is moved, in accordance with the movement of the leading end portion 102A of the photopolymer plate 102, by a guide driving device (not shown) which serves as a part of the receiving guide mechanism. Note that the guide driving device also serves as the driving device of the discharge mechanism section 166, and moves the receiving guide 167 at the same speed as the conveying speed of the photopolymer plate 102.

Thereafter, only the conveying speed of the photopolymer plate 102 is reduced immediately before the conveying of the photopolymer plate 102 is completed. Thus, the receiving guide 167 escapes forward in the conveying direction of the photopolymer plate 102 (FIG. 10D).

Figure 10D:
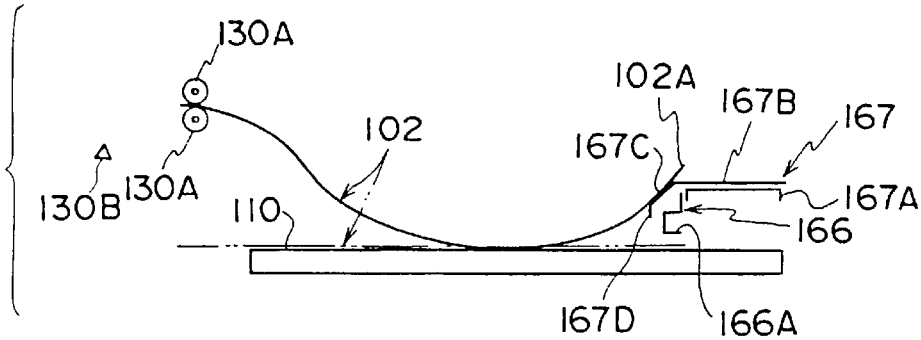
FIG. 10D is a side view illustrating operation of the receiving guide mechanism, and shows an escape position.

As a result, as shown by the double-dot chain line in FIG. 10D, the photopolymer plate 102 lands on the surface plate 110, and the conveying direction trailing end portion thereof is positioned so as to extend off of the surface plate 110. A temporarily supporting plate 154 is disposed for this extended portion of the photopolymer plate 102. The temporarily supporting plate 154 is provided at a moving body 152 which can approach and move away from the surface plate 110. The temporarily supporting plate 154 prevents the photopolymer plate 102 from hanging down.

Further, a cross-shaped suction groove 110B for temporarily holding the photopolymer plate 102 is formed at the surface plate 110 (FIG. 6 and FIGS. 9A through 9C). Air is sucked from the suction groove 110B due to driving of vacuum pump or the like (not shown). If the photopolymer plate 102 exists above the suction groove 110B, the suction groove 110B holds the photopolymer plate 102 at a single point.

A punch stage (which will be described in detail later), which is a processing section for positioning and punch processing the photopolymer plate 102, is disposed at one side of the surface plate 110.

Figure 9A:
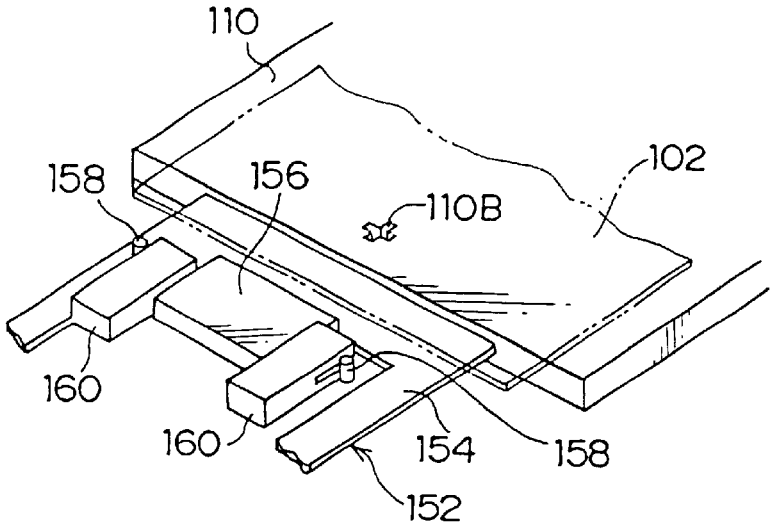
FIG. 9A is a perspective view of a surface plate and a moving body which is for carrying out positioning on the surface plate.
Figure 9B:
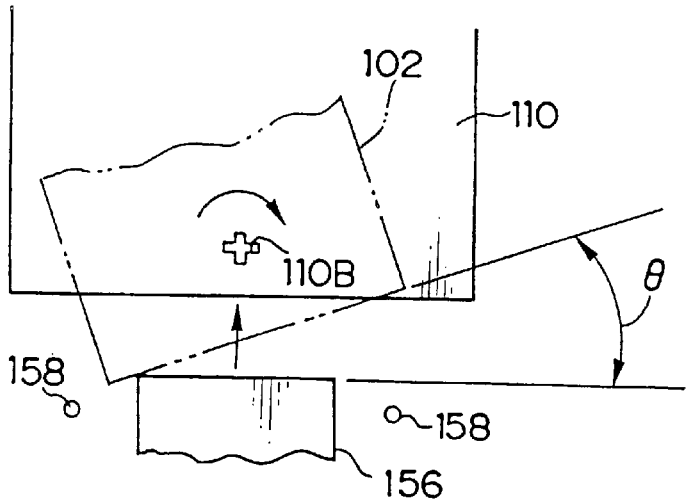
FIG. 9B is a plan view illustrating a photopolymer plate which is placed obliquely on the surface plate.
Figure 9C:
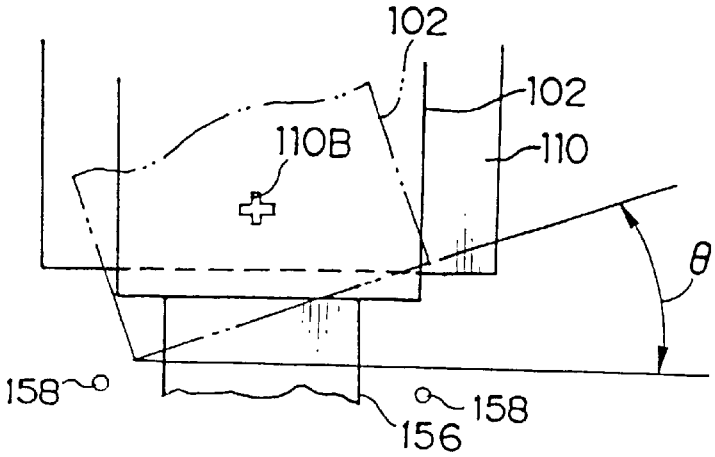
FIG. 9C is a plan view after adjustment of a tilting error of FIG. 9B.

A pusher plate 156, for pushing the trailing end portion of the photopolymer plate 102 in the conveying direction, is provided at a portion of the punch stage. Due to the trailing end portion of the photopolymer plate 102 being pushed by the pusher plate 156, the tilting error of the photopolymer plate 102 (angle θ in FIGS. 9B and 9C) can be eliminated, and the photopolymer plate 102 can be fed out to a predetermined conveying direction reference position. At this reference position, the conveying direction trailing end portion of the photopolymer plate 102 slightly juts out from the surface plate 110. In FIGS. 9A through 9C, the pushing direction front end portion side of the pusher plate 156 is linear in the transverse direction of the pusher plate 156. Note that the pushing direction front end portion side of the pusher plate 156 does not have to be linear in the transverse direction, and a structure may be provided in which a concave portion is provided at the center of the pusher plate, and the photopolymer plate 102 is pushed by only the transverse direction both end portions.

In this case, because the photopolymer plate 102 is held at a single point by the suction groove 110B, the photopolymer plate 102 has a resistance force with respect to the pushing direction. Thus, due to pushing by the pusher plate 156, the photopolymer plate 102 is merely rotated around the point of holding by the suction groove 110B, and the tilting error can almost completely be adjusted at that time.

When the tilting error with respect to the surface plate 110 is adjusted, due to pushing being further continued by the pusher plate 156, positioning of the photopolymer plate 102 in an X direction (the main scanning direction at the time of exposure which will be described later) is carried out.

This positioning is carried out by controlling the amount of pushing by the pusher plate 156. Verification that adjustment of the tilting error has been appropriately effected is carried out by sensors 158 which are provided at plural positions including the both corner portions of the conveying direction trailing end portion of the photopolymer plate 102. In FIGS. 9A through 9C, only two sensors 158 are shown, but there are cases in which there are four sensors 158. Further, these sensors 158 are also used to detect the Y direction (sub-scanning direction during exposure) position of the photopolymer plate 102. Namely, by moving the surface plate 110 in the Y direction, the corner portions of the photopolymer plate 102 are made to coincide with the sensors 158, and this position is registered as the initial position of the photopolymer plate 102.

The photopolymer plate 102, which has been moved to the initial position, is positioned relative to a scanning exposure start position at the exposure section 112. In this state, the photopolymer plate 102 is sucked and held by suction grooves 110A provided at the surface plate 110.

A punch hole is formed in the sucked and held photopolymer plate 102, by a puncher 160 which is set on a punch stage provided at the moving body 152.

The surface plate 110 is reciprocally movable (in the same direction as transverse direction movement for positioning) at a constant speed between a first position (the solid line position in FIG. 1), at which the surface plate 110 receives the photopolymer plate 102 from the photopolymer plate conveying section 130, and a second position (the imaginary line position in FIG. 1), at which the surface plate 110 is accommodated in the exposure section 112.

At the exposure section 112, a scanning unit 164 is provided above the conveying path of the surface plate 110. A laser beam, whose lighting is controlled in accordance with image signals, is main scanned (in a direction orthogonal to the conveying direction of the surface plate 110). The conveying, in one direction, of the surface plate 110 is subscanning movement, and as a result thereof, an image is recorded onto the photopolymer plate 102 on the surface plate 110 during conveying of the surface plate 110 in that one direction toward the exposure section 112. By conveying the surface plate 110 in the opposite direction (the return direction), the surface plate 110 is returned to its original position. The sucking and holding of the photopolymer plate 102 on the surface plate 110 which has returned to its original position is then released.

The discharge mechanism section 166 stands-by, in correspondence with the surface plate 110 after image recording, which has returned to its original position, at the conveying direction trailing end portion side of the photopolymer plate 102 by the photopolymer plate conveying section 130. The discharge mechanism section 166 then passes above the surface plate 110 and is moved toward the conveying direction leading end portion of the photopolymer plate 102.

A hook portion 166A, on which the conveying direction trailing end portion of the photopolymer plate 102 is set, is formed at the lower side of the discharge mechanism section 166 (FIG. 7A).

Figure 7B:
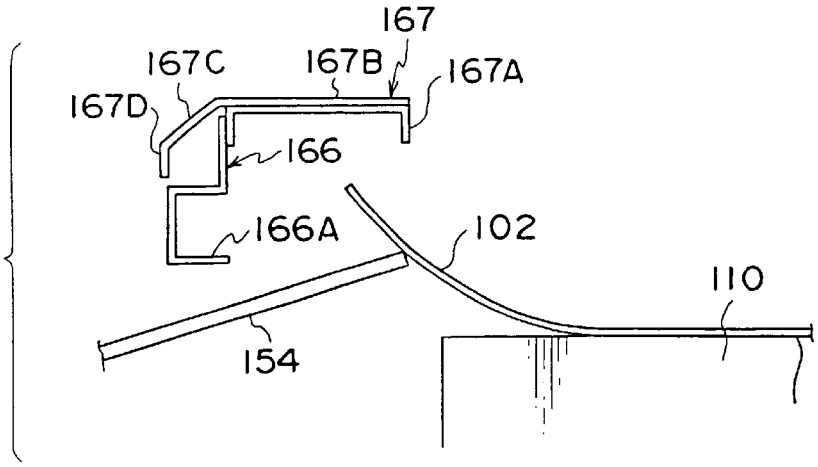
FIG. 7B is a side view illustrating operation of the discharge mechanism section in a state in which a photopolymer plate is raised up.
Figure 7C:
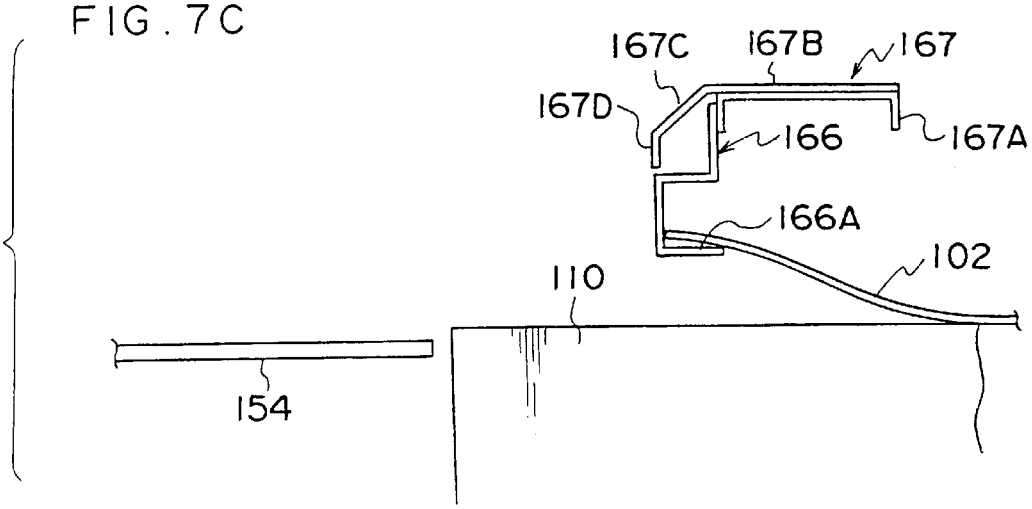
FIG. 7C is a side view illustrating operation of a discharge mechanism section at a time of discharging the photopolymer plate.

As shown in FIG. 7B, the trailing end portion of the photopolymer plate 102, which is jutting out from the surface plate 110, is lifted up by the temporarily supporting plate 154 provided at the moving body 152 (see FIG. 1), and as shown FIG. 7C, the discharge mechanism section 166 is moved in the conveying direction of the photopolymer plate 102. In this way, the photopolymer plate 102 catches on the hook portion 166A, and as the discharge mechanism section 166 moves, the photopolymer plate 102 is conveyed to the downstream side of the surface plate 110.

The buffer section 114 and the automatic developing device 116 are provided at this downstream side. The photopolymer plate 102 is smoothly fed out while the difference between the discharging speed by the discharge mechanism section 116 and the conveying speed in the automatic developing device 116 is absorbed by the buffer section 114.

(Detailed Structure of Carriage 200)

Figure 8:
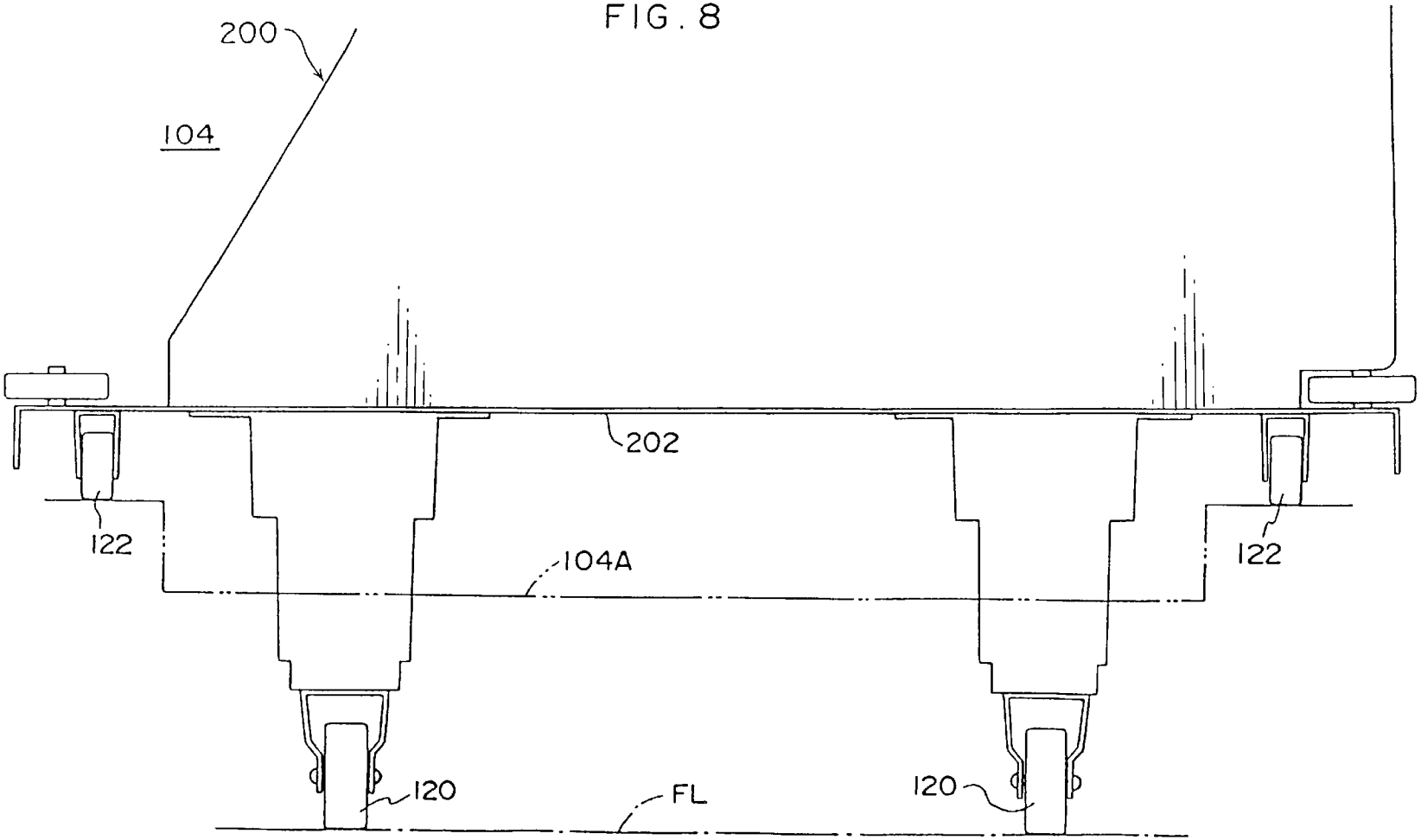
FIG. 8 is an enlarged side view of a lower portion of a carriage.

The carriage 200 is illustrated in FIG. 1. In the carriage 200, a handle 204 (see FIG. 1) is attached to a load carrying platform 202 which is supported on a floor surface FL via the four casters 120 (only two casters 120 are shown in FIG. 8). The handle 204, which is bent in a substantially U-shaped form, is fixed by the both ends thereof thrusting out toward and being attached to the load carrying platform 202.

A stacking section 206, which holds the photopolymer plates 102 in a stacked state, is provided at the load carrying platform 202. The stacking section 206 is shaped as a substantial right triangle as seen from the side thereof. A magazine 208 accommodating the photopolymer plates 102 leans up against the inclined surface portion of the stacking section 206.

In the magazine 208, several tens of photopolymer plates 102 are stacked in advance. (Usually, up to 60 or 100 photopolymer plates 102 can be stacked.) Further, a shutter 210 is provided at the magazine 208. Light-sensitizing of the photopolymer plates 102 can be prevented by keeping the shutter 210 closed in places other than in a dark room.

Namely, the carriage 200 is transported between the plate accommodating section 104 and a dark room in which the photopolymer plates 102 are stored, and the shutter 210 can protect the photopolymer plates 102 during this transport.

The side of the carriage 200 to which the handle 204 is attached is the side which faces toward the rear during transporting, and the carriage 200 is accommodated in the plate accommodating section 104.

Hereinafter, operation of the present embodiment will be described.

In the receiving guide mechanism used in printing plate feeding of the present embodiment, when the photopolymer plate 102 is transferred from the plate supplying section 108 to the surface plate 110, as shown in FIG. 10A, when a sensor 130B, which is provided in a conveying direction upstream side vicinity of nip rollers 130A provided at the exit of the photopolymer plate conveying section 130, detects the photopolymer plate 102, the receiving guide 167 is moved, by the guide driving device, toward the photopolymer plate conveying section 130 (in the direction of arrow A in FIG. 10A) from the standby position which is illustrated in FIG. 10A and which is set at one end portion of the surface plate 110.

Thereafter, as shown in FIG. 10B, the receiving guide 167 stops at the starting position which is set above the photopolymer plate conveying section 130 side end portion of the surface plate 110.

Next, as shown in FIG. 10C, when a predetermined period of time elapses after the photopolymer plate 102 is detected by the sensor 130B, the receiving guide 167 starts to move from the starting position toward the standby position (i.e., in the direction of arrow B) at the same speed as the conveying speed of the photopolymer plate 102.

As a result, at the point in time at which the receiving guide 167 has moved a predetermined amount in the direction of arrow B (i.e., at a receiving position), the leading end portion 102A of the photopolymer plate 102 abuts the flat plate portion 167B of the receiving guide 167. Namely, the leading end portion 102A of the photopolymer plate 102 is received by the flat plate portion 167B of the receiving guide 167.

Thereafter, as shown in FIG. 10D, immediately before the conveying of the photopolymer plate 102 is completed, only the conveying speed of the photopolymer plate 102 is reduced. Thus, the moving speed of the receiving guide 167 is faster than the conveying speed of the photopolymer plate 102, and the receiving guide 167 escapes forward in the conveying direction of the photopolymer plate 102.

As a result, as shown by the two-dot chain line in FIG. 10D, the photopolymer plate 102 lands on the surface plate 110.

Accordingly, in the present embodiment, it is not the case that the leading end of the photopolymer plate 102 falls directly on the surface plate, and thereafter, slides on the surface plate, as in conventional structures. Thus, the upper surface of the surface plate is not abraded, and scratches are not formed on the upper surface of the surface plate 110. As a result, abrasion and scratching of the surface plate 110 can be prevented, and simultaneously, scratching of the photopolymer plate 102 can be prevented.

Further, in the present embodiment, by making the moving speed of the receiving guide 167 faster than the conveying speed of the photopolymer plate 102 immediately before the conveying of the photopolymer plate 102 is finished, the receiving guide 167 can reliably escape forward in the conveying direction of the photopolymer plate 102 immediately before completion of the conveying of the photopolymer plate 102, due to the relative movement of the receiving guide 167 and the photopolymer plate 102. Therefore, the photopolymer plate 102 can reliably be made to land on the surface plate 110.

Further, in the present invention, by providing the receiving guide 167 at the discharge mechanism section 166, the supporting members and the guide driving device of the receiving guide 167 can be used in common as the supporting members and the driving device of the discharge mechanism section 166. Thus, the number of parts can be decreased.

The present invention was described in detail above with reference to a specific embodiment. However, the present invention is not limited to the present embodiment, and it should be obvious to a person skilled in the art that other various embodiments are possible within the scope of the present invention. For example, in the above-described embodiment, by decreasing the conveying speed of the photopolymer plate 102 immediately before conveying of the photopolymer plate 102 is completed, the moving speed of the receiving guide 167 is made to be faster than the conveying speed of the photopolymer plate 102. However, instead, the moving speed of the receiving guide 167 maybe made to be faster than the conveying speed of the photopolymer plate 102 by increasing the moving speed of the receiving guide 167 immediately before completion of conveying of the photopolymer plate 102.

Moreover, the moving speed of the receiving guide 167 may be set to be a constant speed which is slightly faster than the conveying speed of the photopolymer plate 102, and the leading end portion 102A of the photopolymer plate 102 may slide on the flat plate portion 167B of the receiving guide 167 which is moving, and the leading portion 102A of the photopolymer plate 102 may fall from its position on the flat plate portion 167B of the receiving guide 167 immediately before conveying of the photopolymer plate 102 is finished.

Further, in the present embodiment, the receiving guide 167 is provided at the discharge mechanism section 166. However, the receiving guide 167 and the discharge mechanism section 166 may be provided separate from one another.

What is claimed is:

1. An apparatus for feeding and ejecting a printing plate onto a surface plate, comprising:

a conveying section, located adjacent to the surface plate, for conveying the printing plate to the surface plate and imparting a conveying speed to the printing plate;

a receiving guide adapted to receive a leading end portion of the printing plate which is being conveyed to the surface plate at the conveying speed by the conveying section, the receiving guide being moved at a movement speed in accordance with the conveying speed of the leading end portion of the printing plate, wherein immediately before conveyance of the printing plate by the conveying section is completed, the receiving guide being made to advance ahead in a conveying section is completed, the receiving guide being made to advance ahead in a conveying direction of the printing plate, which results in the printing plate being set on the surface plate.

2. The apparatus of claim 1, wherein said movement speed of the receiving guide is faster than said conveying speed of the printing plate immediately before conveyance of the printing plate by the conveying section is completed.

3. The apparatus of claim 2, wherein the receiving guide includes an inclined surface provided at a printing plate conveying direction upstream side of the receiving guide.

4. The apparatus of claim 3, wherein the receiving guide is provided substantially with a discharge device provided above the surface plate to discharge printing plates from the surface plate.

5. The apparatus of claim 2, wherein the receiving guide is provided substantially with a discharge device provided above the surface plate to discharge printing plates from the surface plate.

6. The apparatus of claim 2, wherein the receiving guide is controlled together with control of a discharge device provided above the surface plate to discharge printing plates from the surface plate.

7. The apparatus of claim 1, wherein the receiving guide includes an inclined surface provided at a printing plate conveying direction upstream side of the receiving guide.

8. The apparatus of claim 7, wherein the receiving guide is provided substantially with a discharge device provided above the surface plate to discharge printing plates from the surface plate.

9. The apparatus of claim 8, wherein the receiving guide is controlled together with control of the discharge device.

10. The apparatus of claim 1, wherein the receiving guide is provided substantially with a discharge device provided above the surface plate to discharge printing plates from the surface plate.

11. The apparatus of claim 10, wherein the receiving guide is controlled together with control of the discharge device.

12. The apparatus of claim 1, wherein the receiving guide is controlled together with control of a discharge device provided above the surface plate to discharge printing plates from the surface plate.

* * * * *